US008619066B2

(12) United States Patent
Ahn et al.

(10) Patent No.: US 8,619,066 B2
(45) Date of Patent: Dec. 31, 2013

(54) LIQUID CRYSTAL DISPLAY

(75) Inventors: Ik-Huyn Ahn, Asan-si (KR); Woo-Chul Kim, Seoul (KR); Byung-Koan Kim, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 517 days.

(21) Appl. No.: 12/889,793

(22) Filed: Sep. 24, 2010

(65) Prior Publication Data

US 2011/0248966 A1 Oct. 13, 2011

(30) Foreign Application Priority Data

Apr. 13, 2010 (KR) ..... 10-2010-0033605

(51) Int. Cl.
*G09G 3/36* (2006.01)

(52) U.S. Cl.
USPC ..... 345/204; 345/99

(58) Field of Classification Search
None
See application file for complete search history.

(56) References Cited

U.S. PATENT DOCUMENTS

| | | | | |
|---|---|---|---|---|
| 5,874,931 | A | 2/1999 | Drake et al. | |
| 2006/0197730 | A1 * | 9/2006 | Ooga et al. | 345/98 |
| 2010/0045588 | A1 * | 2/2010 | Lee et al. | 345/99 |
| 2010/0302214 | A1 * | 12/2010 | Kim et al. | 345/204 |

FOREIGN PATENT DOCUMENTS

| | | |
|---|---|---|
| JP | 2004-258879 | 9/2004 |
| JP | 2007-079077 | 3/2007 |
| KR | 1020020007577 | 1/2002 |
| KR | 1020050112654 | 12/2005 |
| KR | 1020060023456 | 3/2006 |
| KR | 1020060039243 | 5/2006 |
| KR | 1020080029711 | 4/2008 |
| KR | 1020080048777 | 6/2008 |
| KR | 1020080075729 | 8/2008 |

* cited by examiner

*Primary Examiner* — Bipin Shalwala
*Assistant Examiner* — Kwin Xie
(74) *Attorney, Agent, or Firm* — F. Chau & Associates, LLC

(57) ABSTRACT

A liquid crystal display includes a display unit displaying an image in response to a driving signal, a driving unit outputting the driving signal to the display unit in response to a plurality of control signal, and a controller outputting the plurality of control signals and image data. The controller includes a plurality of timing controllers providing the image data and the plurality of control signals and a storage device. The plurality of timing controllers share the storage device and may be either connected in series or parallel.

20 Claims, 6 Drawing Sheets

LIQUID CRYSTAL DISPLAY

CROSS-REFERENCE TO RELATED APPLICATIONS

This application claims priority to Korean Patent Application No. 2010-0033605, filed on Apr. 13, 2010 in the Korean Intellectual Property Office (KIPO), the disclosure of which is incorporated by reference in its entirety herein.

BACKGROUND

1. Technical Field

Embodiments of the present invention relate to a liquid crystal display and more particularly, a liquid crystal display with a controller unit having a plurality of timing controllers that control driving of the liquid crystal display.

2. Discussion of Related Art

A liquid crystal display may include a liquid crystal panel that displays an image in response to a data signal and a gate signal, a data driving unit that outputs the data signal, and a gate driving unit that outputs the gate signal.

The liquid crystal display may include a timing controller controlling the data driving unit and the gate driving unit. The timing controller may receive picture data and an external controller signal to generate image data and various controller signals.

The need for a liquid crystal display with a high resolution and a high driving speed is rapidly increasing. Such a display may include many timing controllers, where each timing controller includes its own storage device for storing a corresponding driving setting value.

However, a liquid crystal display with several such timing controllers and storage devices can be expensive to manufacture and may occupy an unnecessarily large amount of space.

BRIEF SUMMARY OF THE INVENTION

A liquid crystal display according to an exemplary embodiment of the invention includes a display unit displaying an image in response to a driving signal, a driving unit outputting the driving signal to the display unit in response to a plurality of control signals, and a controller outputting the plurality of control signals and image data. The controller includes a plurality of timing controllers providing the image data and the plurality of control signals and a shared storage device. The plurality of timing controllers are connected in series to one another and are each electrically connected to the shared storage device.

A liquid crystal display according to an exemplary embodiment of the invention includes a display unit displaying an image in response to a driving signal, a driver outputting the driving signal to the display unit in response to a plurality of control signals, and a controller outputting the plurality of control signal and image data. The controller includes a plurality of timing controllers providing image data and the plurality of control signals and a shared storage device. The plurality of timing controllers are connected in parallel to one another and are each electrically connected to the shared storage device.

A liquid crystal display according to an exemplary embodiment of the present invention includes a display unit displaying an image in response to a driving signal, a driving unit outputting the driving signal to the display unit in response to a plurality of control signals, a controller outputting the plurality of control signals and image data. The controller includes a first timing controller receiving an externally provided reset signal and outputting a first ready completion signal, a second timing controller receiving the first ready completion signal and outputting a second ready completion signal to the first timing controller and as one of the control signals, a shared storage device storing driving setting values for each of the timing controllers, and a panel driving power unit outputting power to a panel of the display unit in response to receipt of the second ready completion signal transitioning from one logic level to a second and different logic level. The timing controllers are both connected to the shared storage device for retrieving their respective setting values.

The first timing controller may be configured to output the first ready completion signal of a continuous same level when it is unable to interface with the storage device, the second timing controller may be set to a non-active state upon receipt of the first ready completion signal of the continuous same level to prevent the panel driving power unit from operating to supply the power.

BRIEF DESCRIPTION OF THE DRAWINGS

The present invention will become more readily apparent by describing in further detail exemplary embodiments thereof with reference to the accompanying drawings, in which.

DETAILED DESCRIPTION OF EXEMPLARY EMBODIMENTS

Figure 1:
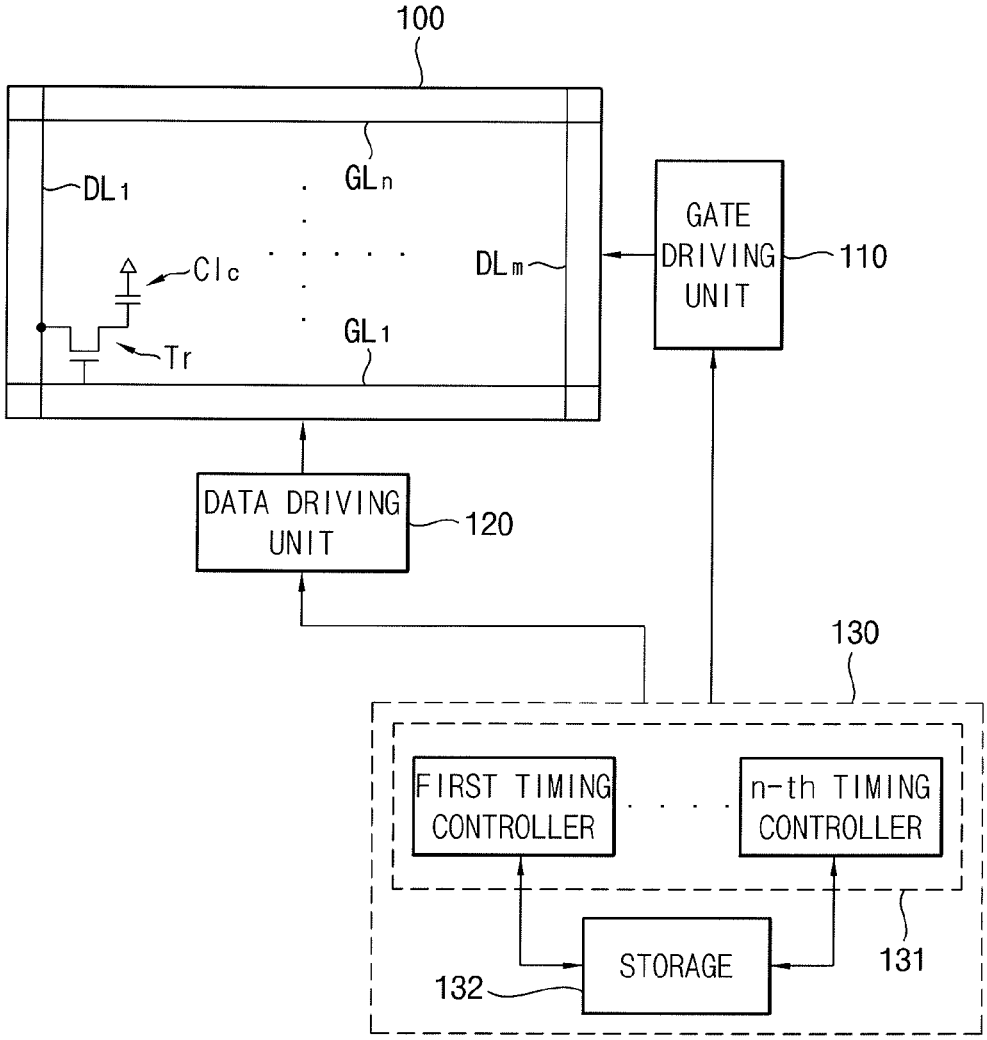
FIG. 1 is a schematic view of an exemplary embodiment of the present invention.

The invention will now be described more fully hereinafter with reference to the accompanying drawings, in which exemplary embodiments thereof are shown. The present invention may, however, be embodied in many different forms and should not be construed as limited to the exemplary embodiments set forth herein. Like reference numerals refer to like elements throughout.

It will be understood that when an element is referred to as being "on" another element, it can be directly on the other element or intervening elements may be present therebetween. Hereinafter, exemplary embodiments of the present invention will be explained in further detail with reference to the accompanying drawings.

FIG. 1 is a schematic view of an exemplary embodiment of the present invention. Referring to FIG. 1, the liquid crystal display comprises a display unit 100, a gate driving unit 110, a data driving unit 120, and a controller 130.

The display unit 100 includes a plurality of gate lines $GL_1$-$GL_n$ and a plurality of data lines $DL_1$-$DL_m$ crossing the gate lines $GL_1$-$GL_N$, where n and m are positive integers. The display unit 100 further includes a plurality of pixels connected to the gate lines $GL_1$-$GL_N$ and the data lines $DL_1$-$DL_M$.

At least one of the pixels comprises a thin film transistor Tr and a liquid crystal capacitor Clc. For example, a gate electrode of the thin film transistor Tr in the first pixel is connected to the first gate line $GL_1$, a source electrode is connected to the first data line $DL_1$, and a drain electrode is connected to the first terminal of the liquid crystal capacitor Clc.

The gate driving unit 110 is electrically connected to a plurality of gate lines $GL_1$-$GL_n$ and outputs a gate signal to the gate lines $GL_1$-$GL_n$. The data driving unit is electrically connected to the plurality of data lines DL1-$DL_M$ and outputs a data signal to the data lines. The controller 130 includes a plurality of timing controllers 131 and a storage device 132.

At least one of the timing controllers receives picture data and an external controller signal for generating image data and various controller signals. The various controller signals may include a signal related to driving the liquid crystal display and a timing controller ready completion signal.

At least one of the timing controllers may receive a mode selection value. According to the received value, the timing controller is set for identification. For example, if the controller includes 4 timing controllers, each timing controller could receive a respective one of "00", "01", "10", "11" as a mode selection value. The received value is set for identification of each timing controller.

Each timing controller may receive a reset signal and to be set to an active state or a non-active state according to the reset signal. For example, if a timing controller receives a reset signal of a logic "0" (e.g., from an external apparatus), the timing controller is set to a non-active state. If a timing controller receives a reset signal of a logic "1" (e.g., from an external apparatus), the timing controller is set to an active state. When the timing controller is set to the active state, the timing controller may read a driving setting value from the storage device 132.

Each timing controller may be capable of outputting a timing controller ready completion signal. The timing controller ready completion signal may be outputted when the timing controller is ready to be used for displaying a screen.

Each timing controller may communicate with the storage device 132 using a predetermined interface. For example, at least one of the timing controllers may communicate with the storage device 132 using an inter-integrated circuit ($I^2C$) protocol.

Figure 2:
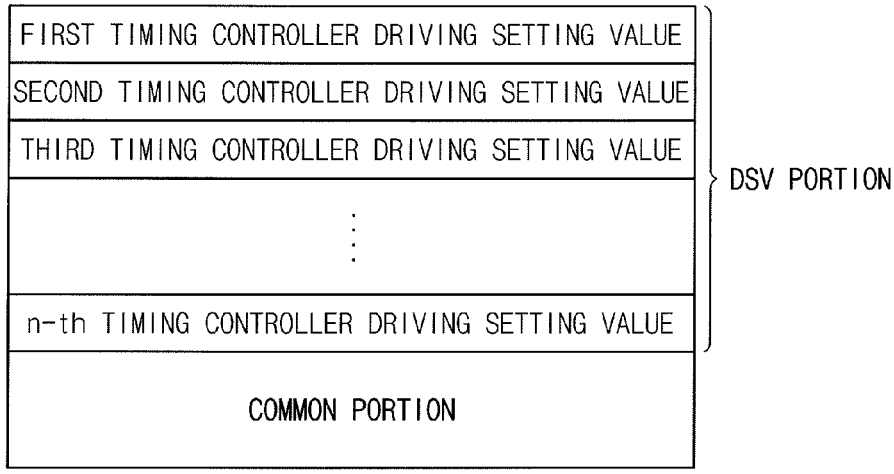
FIG. 2 is an exemplary view of a storage device in FIG. 1.

The storage device 132 stores at least one driving setting value. The driving setting value is related to driving of the liquid crystal display, and is a value set in at least one of the timing controllers. As shown in FIG. 2, the storage device 132 includes a plurality of driving setting values stored in a driving setting value (DSV) portion and a driving setting value stored in a common portion. A distinct driving setting value in the DSV portion may correspond to a different respective one of the timing controllers. The driving setting value in the common portion corresponds to all the timing controllers.

The driving setting values in the DSV portion are stored in different addresses in the storage device 132. For example, the driving setting value of the DSV portion corresponding to the first timing controller is stored in a (A, B) address in the storage device 132, and the driving setting value of the DSV portion corresponding to the second timing controller is stored in a (C, D) address in the storage device 132. The common portion is stored in an address that is different from the DSV portion.

Figure 3:
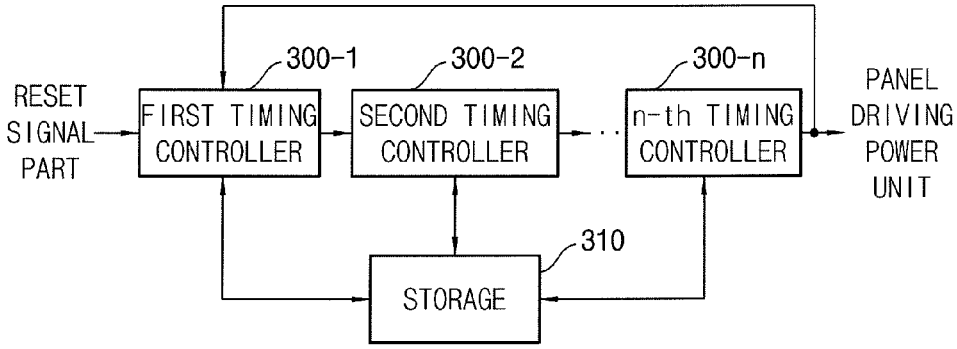
FIG. 3 is an embodiment of timing controllers connected to a storage device according to an exemplary embodiment of the invention.

FIG. 3 illustrates an embodiment of timing controllers connected to a storage device according to an exemplary embodiment of the invention. A plurality of timing controllers 300-1, 300-2, . . . , **300-*n* are connected in series. Each timing controller shares a same storage device 310. A timing controller ready completion signal output from the first timing controller 300-1 is input to the second timing controller 300-2 as a reset signal. The timing controller ready completion signal output from the second timing controller 300-2 is input to a third timing controller as a reset signal, etc. In this way, the timing controller ready completion signal output from a terminal of a previous timing controller is input to a terminal of a next timing controller as a reset signal. However, the timing controller ready completion signal output from the last timing controller 300-*n* is input to the first timing controller 300-1**. Accordingly, the plurality of timing controllers forms a returned loop.

The plurality of timing controllers formed to have the returned loop may reduce the occurrence of abnormally displayed images. For example, an abnormal screen may be observed on the display when an incorrect driving setting value is set within a timing controller because of an interface error between the timing controller and the storage device 310 or when the timing controller has an error. The abnormal image may not be displayed when all the timing controllers are shut-down through the returned loop.

For example, the first timing controller 300-1 may be set to an active state when a reset signal transitions from a logic "0" to a logic "1". When the first timing controller is set to the active state, the first timing controller 300-1 reads a driving setting value from the storage device 310 through an interface between the first timing controller 300-1 and the storage device 310. The read driving setting value includes a driving setting value in the DSV portion corresponding to the first timing controller 300-1 and a driving setting value in the common portion.

After reading the driving setting values, the first timing controller 300-1 outputs a timing controller ready completion signal while the timing controller completion signal transitions from a logic "0" to a logic "1". The outputted timing controller ready completion signal is inputted to the second timing controller 300-2 as a reset signal. The time when the timing controller ready completion signal transitions from a logic "0" to a logic "1" is not limited to the time after communication is finished between a timing controller and the storage device 310. For example, when communication has not yet finished between a timing controller and the storage device 310, a value of the timing controller ready completion signal can be changed according to a user's selection.

The second timing controller 300-2 operates in a manner similar to the first timing controller 300-1, when the reset signal transitions from a logic "0" to a logic "1". The driving setting value read from the storage device 310 by the second timing controller 300-2 includes a driving setting value from the DVS portion corresponding to the second timing controller 300-2 and a driving setting value in the common portion of the storage device 310.

The plurality of timing controllers operate sequentially, a timing controller ready completion signal output from the last timing controller **300-*n* transitions from a logic "0" to a logic "1", and is input to a panel driving power unit and the first timing controller 300-1**.

The panel driving power unit outputs power in response to receipt of the input timing controller ready completion signal transitioning from a logic "0" to a logic "1". The first timing controller 300-1 receives the timing controller ready completion signal transitioning from a logic "0" to a logic "1" and maintains a state of the timing controller ready completion signal being currently output from the first timing controller 300-1.

If a timing controller has an error or an error occurs while communicating with the storage device 310, the timing controller ready completion signal of the timing controller maintains a logic "0". The timing controller ready completion signal of a logic "0" is input to a terminal of a next timing controller as a reset signal, and the timing controller which receives the reset signal of a logic "0" maintains a non-active state. The timing controller ready completion signal output from the last timing controller 300-*n* maintains a logic "0" state, and thus the panel driving power unit does not operate (e.g., does not output a power signal). The first timing controller 300-1 receives the timing controller ready completion signal of a logic "0", and outputs a timing controller ready completion signal of a logic "0" regardless of its current state. All the timing controllers in series with one another are set to a non-active state when the timing controller ready completion output from the first timing controller 300-1 is a logic "0".

Figure 4A:
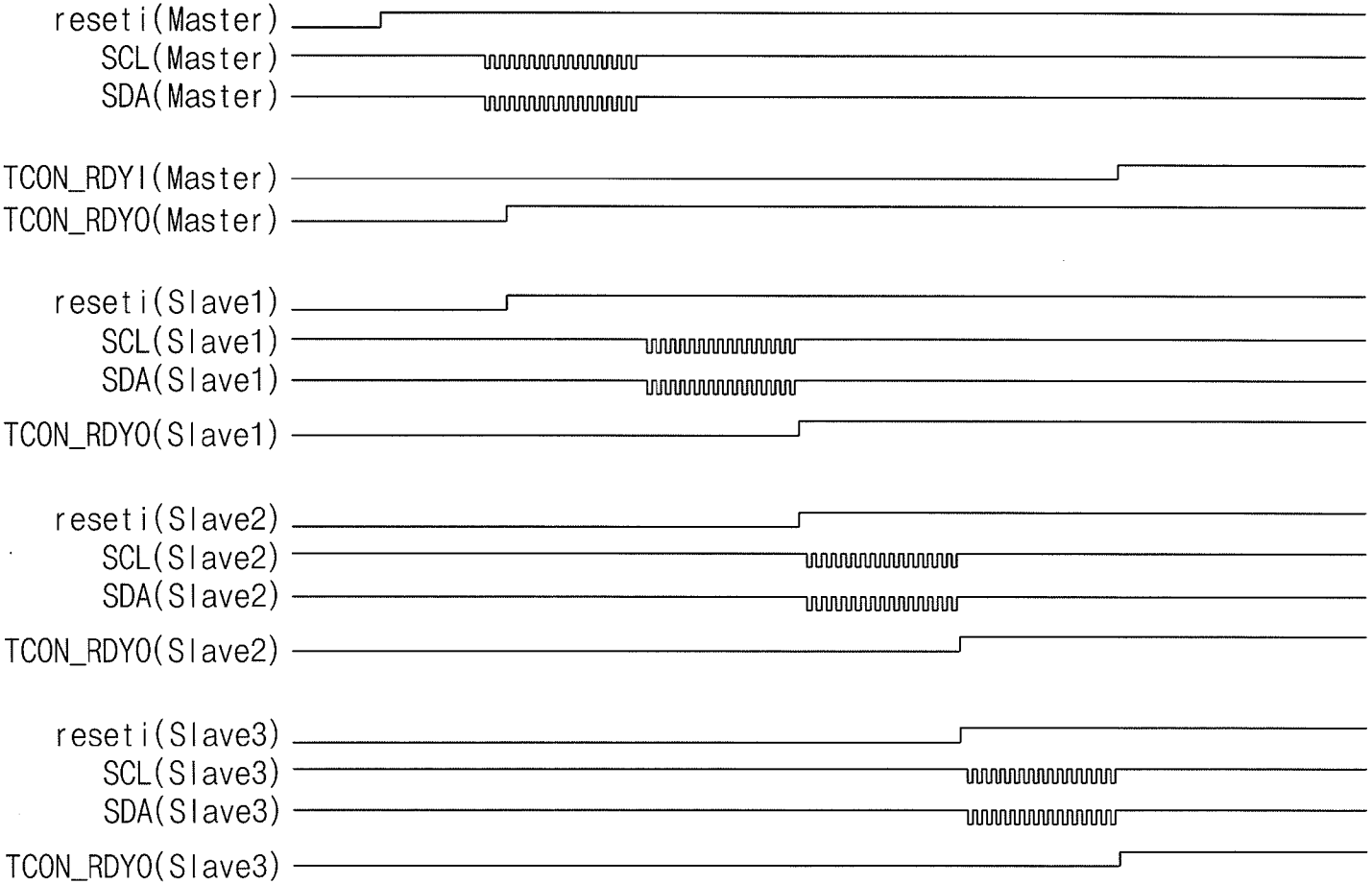
FIG. 4A and FIG. 4B are exemplary timing diagrams of the embodiment in FIG. 3.
Figure 4B:
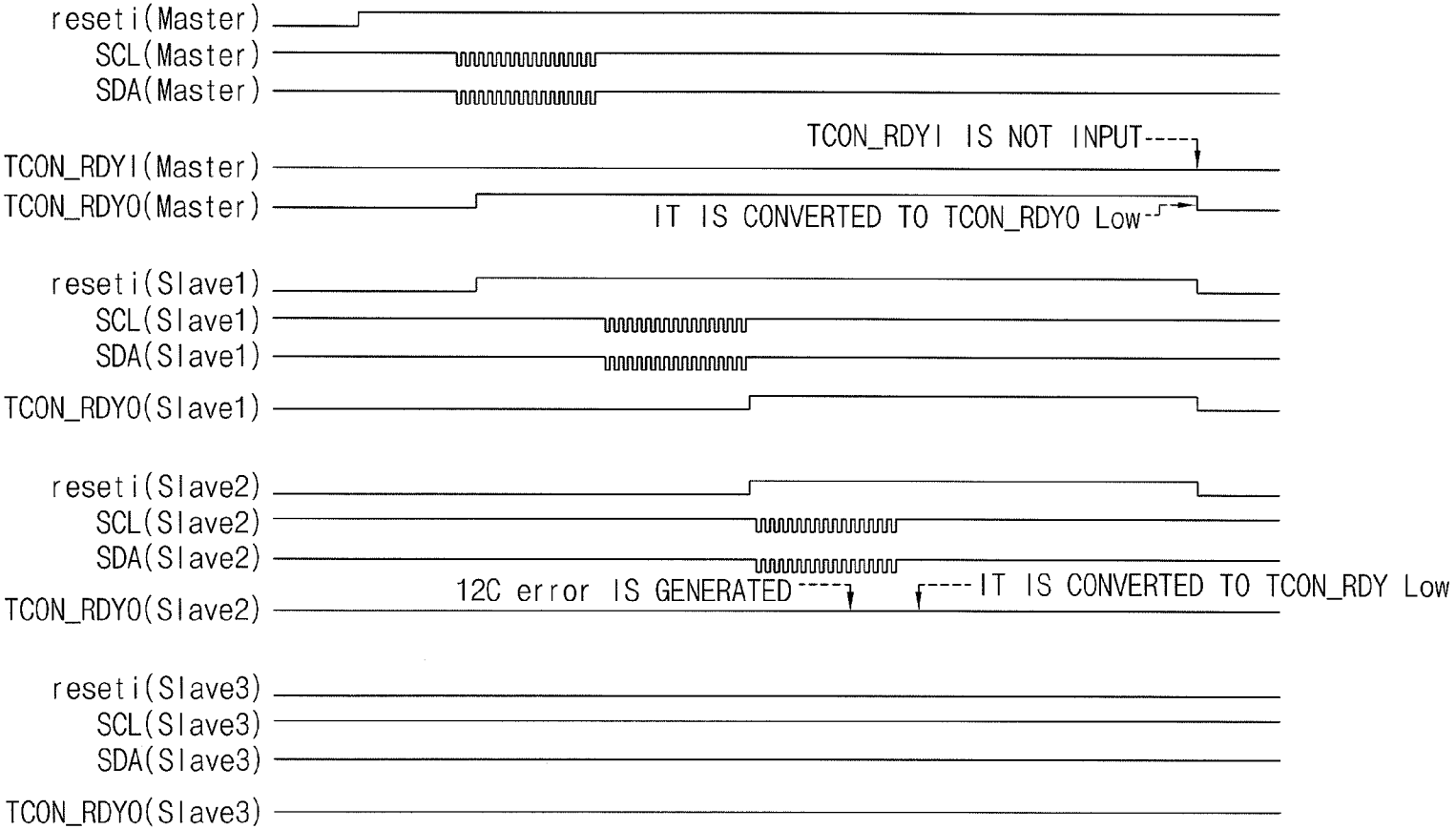

FIG. 4A and FIG. 4B are exemplary timing diagrams of the embodiment in FIG. 3. For example, the signal "reset i" may refer to the reset signal, the SCL signal may refer to a serial clock signal used in the $I^2C$ protocol, the SDA signal may refer to a serial data signal used in the $I^2C$ protocol, and a TCON_RDY signal may refer to a timing controller ready completion signal. One of the timing controllers may be configured as the master, while the other timing controllers may be configured as slaves in the $I^2C$ protocol. For example, the $I^2C$ protocol is a multi-master serial single-ended computer bus. Alternately, an external device that provides the initial reset signal to the first timing controller could be the master, and all of the timing controllers could be the slaves.

Figure 5:
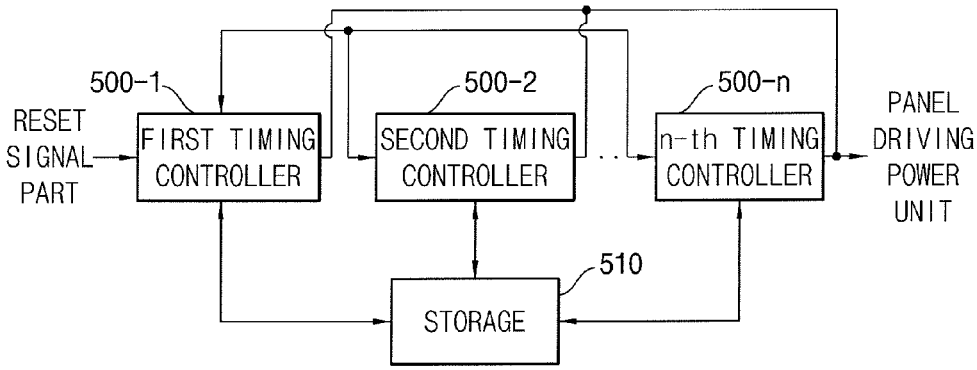
FIG. 5 is an embodiment of timing controllers connected to a storage device according to an exemplary embodiment of the invention.

FIG. 5 illustrates an embodiment of a plurality of timing controllers connected to a storage device according to an exemplary embodiment of the invention. The plurality of timing controllers 500-1, 500-2, . . . , 500-*n* are connected in parallel with one another, and each timing controller shares the storage device 510. For example, the plurality of timing controllers receives a same reset signal (e.g., from an external circuit), and each timing controller outputs a timing controller ready completion signal to a panel driving power unit. At least one of the timing controllers may receive a mode selection value, where a mode selection value is set for identification as discussed above. Each timing controller may communicate with the storage device 510 using a predetermined interface and the storage device 510 may include a DVS portion and common portion as described above.

The timing controllers of FIG. 5 in parallel receive a same reset signal, and the plurality of timing controllers may be set to and active state or an non-active state simultaneously. If a timing controller is set to an active state, the timing controller reads a driving setting value stored in the storage 510. Further, each timing controller ready completion signal output from each timing controller is output to the panel driving power unit.

For example, when the reset signal input to a timing controller transitions from a logic "0" to a logic "1", all the timing controllers in parallel are set to an active state. All the timing controllers set to the active state read the driving setting value from the storage device 510 through interfacing with the storage device 510.

When each timing controller reads a driving setting value, each timing controller may store a driving setting value corresponding to the timing controller and ignore a driving setting value corresponding to another timing controller after reading all the driving setting values in the storage device 510. If one of the timing controllers is set to a wrong driving setting value or the timing controller has an error, the panel driving power unit may be shut-down.

Figure 6:
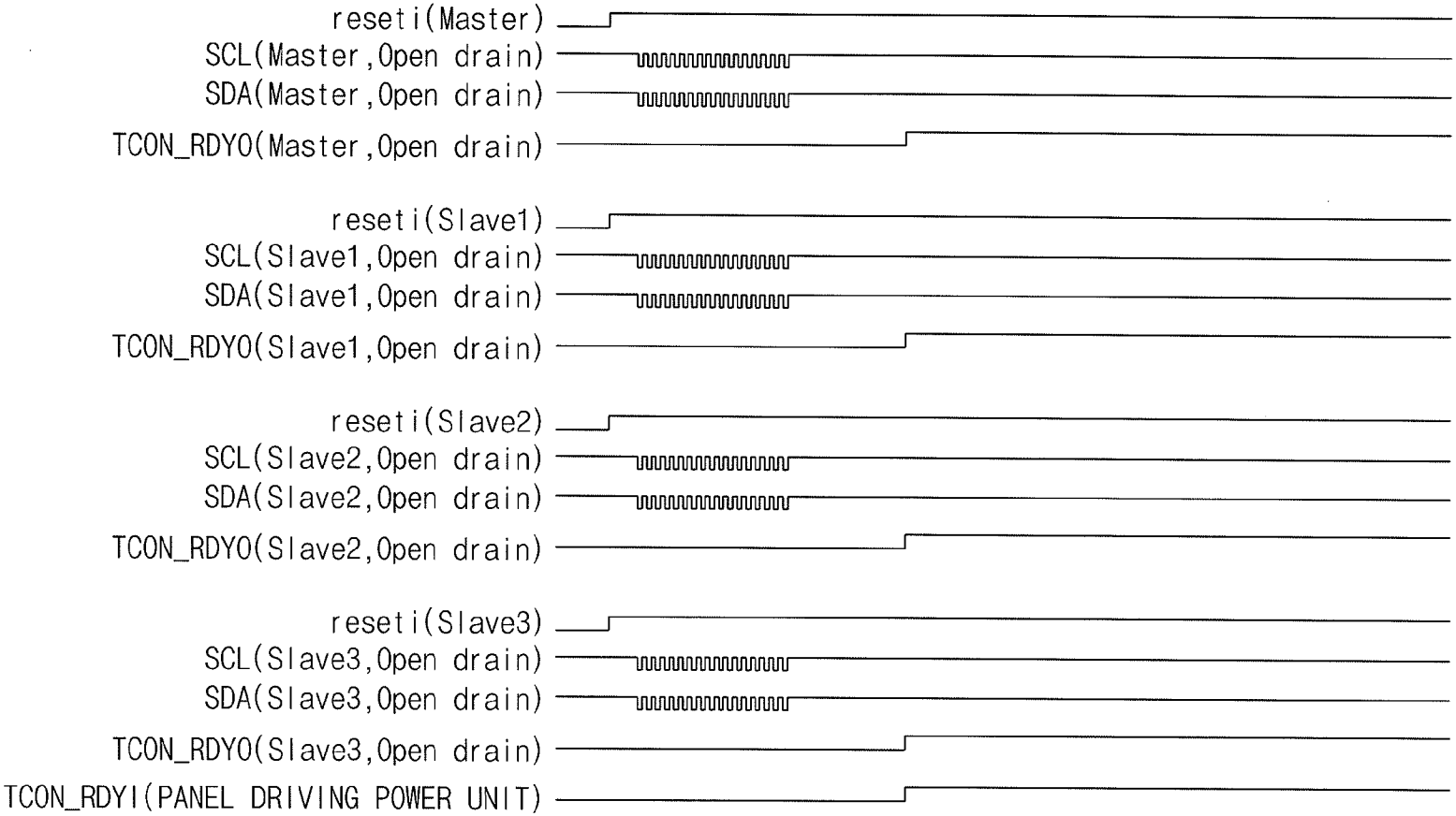
FIG. 6 is an exemplary timing diagram of the embodiment in FIG. 5.

FIG. 6 illustrates an exemplary timing diagram of the embodiment in FIG. 5. As discussed above, the signal "reset i" may be used as the reset signal, the first timing controller 300-1 may be used as a master in the $I^2C$ protocol, and the other timing controllers may be used as slaves in the $I^2C$ protocol.

Having described exemplary embodiments of the present invention, those skilled in the art will readily appreciate that many modifications can be made in the exemplary embodiments without departing from the present invention. Accordingly, all such modifications are intended to be included within the scope of the disclosure.

What is claimed is:

1. A liquid crystal display comprising:

a display unit displaying an image in response to a driving signal;

a driving unit outputting the driving signal to the display unit in response to a plurality of control signals; and a controller outputting the plurality of control signals and image data, wherein the controller comprises:

a plurality of timing controllers providing the image data and the plurality of control signals; and a shared storage device, wherein the plurality of timing controllers are connected in series to one another and are each electrically connected to the shared storage device, wherein a current one of the timing controllers outputs a reset signal to a next one of the timing controllers after reading, from the shared storage device, a first driving setting value corresponding to the current timing controller and a second driving setting value corresponding to all the timing controllers, wherein the reset signal maintains a first logic level when the current timing controller has an error while communicating with the shared storage device, and otherwise transitions from the first logic level to a second other logic level.

2. The liquid crystal display of claim 1, wherein the plurality of timing controllers receive the reset signal, and each timing controller is set to one of an active state or a non-active state according to the reset signal.

3. The liquid crystal display of claim 2, wherein each timing controller is set to the active state when the reset signal is a logic "0" and the non-active state when the reset signal is a logic "1".

4. The liquid crystal of claim 2, wherein the timing controllers number N, the first timing controller receives the reset signal from an external device, the K-th timing controller receives a timing controller ready completion signal of the (K−1)-th timing controller as the reset signal, K is a positive integer less than or equal to N, and N is at least 3.

5. The liquid crystal display of claim 1, wherein the storage device comprises:

a first portion comprising a plurality of driving setting values, wherein each driving setting value corresponds to a respective one of the timing controllers; and a second portion comprising the driving setting value that corresponds to all the timing controllers.

6. The liquid crystal display of claim 5, wherein the current timing controller reads the first driving setting value in the first portion corresponding to the current timing controller and the second driving setting value in the second portion when the current timing controller is set to the non-active state.

7. The liquid crystal display of claim 1, wherein the reset signal output by the current timing controller transitions from a logic "0" to a logic "1", after the current timing controller reads the first driving setting value and the second driving setting value.

8. The liquid crystal display of claim 4, wherein the first timing controller receives the timing controller ready completion signal output from the last timing controller.

9. The liquid crystal display of claim 8, further comprising a panel driving power unit, wherein the timing controller ready completion signal is output from the last timing controller to the panel driving power unit, and the panel driving unit outputs driving power to a panel of the display unit.

10. The liquid crystal display of claim 9, wherein at least one of the timing controllers communicate with the storage device using an inter-integated circuit (I2C) protocol.

11. A liquid crystal display comprising:

a display unit displaying an image in response to a driving signal;

a driver outputting the driving signal to the display unit in response to a plurality of control signals; and a controller outputting the plurality of control signal and image data, wherein the controller comprises:

a plurality of timing controllers providing image data and the plurality of control signals; and a shared storage device, wherein the plurality of timing controllers are connected in parallel to one another and are each electrically connected to the shared storage device, wherein all the plurality of timing controllers output a reset signal to a same output node.

12. The liquid crystal display of claim 11, wherein the plurality of timing controllers receive the reset signal and each timing controller is set to one of an active state or a non-active state according to the reset signal.

13. The liquid crystal display of claim 12, wherein a first one of the plurality of timing controllers receives the reset signal from an external circuit and at least one of the timing controllers is set to the active state when the reset signal is a logic "0" and is set to the non-active state when the reset signal is a logic "1".

14. The liquid crystal display of claim 13, wherein the storage device comprises:

a first portion comprising a plurality of driving setting values, wherein each driving setting value corresponds to a respective one of the timing controllers; and a second portion comprising a driving setting value that corresponds to all the timing controllers.

15. The liquid crystal display of claim 14, wherein a timing controller reads a driving setting value in the first portion corresponding to the timing control and a driving setting value in the second portion.

16. The liquid crystal display of claim 13, wherein a timing controller ready completion signal transitioning from a logic "0" to a logic "1" is output by a timing controller after the timing controller reads a driving setting value.

17. The liquid crystal display of claim 13, wherein a timing controller ready completion signal is output from the plurality of timing controllers to a panel driving power unit outputting driving power to a panel of the display unit.

18. The liquid crystal display 17, wherein at least one of the timing controllers communicate with the storage device using an inter-integrated circuit (I2C) protocol.

19. A liquid crystal display comprising:

a display unit displaying an image in response to a driving signal;

a driving unit outputting the driving signal to the display unit in response to a plurality of control signals;

a controller outputting the plurality of control signals, image data, wherein the controller comprises:

a first timing controller receiving an externally provided reset signal and outputting a first ready completion signal;

a second timing controller receiving the first ready completion signal for placing the second timing controller in one of an active and non-active state and outputting the first ready completion signal as a second ready completion signal to the first timing controller and as one of the control signals;

a shared storage device storing driving setting values for each of the timing controllers, wherein the timing controllers are both connected to the shared storage device for retrieving their respective setting values; and a panel driving power unit outputting power to a panel of the display unit in response to receipt of the second ready completion signal.

20. The liquid crystal display of claim 19, wherein the first timing controller is configured to output the first ready completion signal of a continuous same level when it is unable to interface with the storage device, wherein the second timing controller is set to the non-active state upon receipt of the first ready completion signal of the continuous same level to prevent the panel driving power unit from operating to supply the power.

* * * * *